United States Patent [19]

Dokken

[11] Patent Number: 4,738,717

[45] Date of Patent: Apr. 19, 1988

[54] METHOD FOR CONTROLLING THE DENSITY OF SOLIDIFIED ALUMINUM

[75] Inventor: Roger N. Dokken, Katonah, N.Y.

[73] Assignee: Union Carbide Corporation, Danbury, Conn.

[21] Appl. No.: 881,383

[22] Filed: Jul. 2, 1986

[51] Int. Cl.[4] ..... C22B 21/06

[52] U.S. Cl. ..... 75/68 R; 164/56.1; 266/91

[58] Field of Search ..... 75/20 F, 68 R, 93 E; 266/91; 164/4.1, 56.1, 68.1, 79

[56] References Cited

U.S. PATENT DOCUMENTS 4,040,610 8/1977 Szekely ..... 266/235

4,556,535 12/1985 Bowman et al. ..... 266/91

FOREIGN PATENT DOCUMENTS 2282479 3/1976 France ..... 75/20 F

*Primary Examiner*—Melvyn J. Andrews

*Attorney, Agent, or Firm*—Alvin H. Fritschler

[57] ABSTRACT

An aluminum melt is processed by the injection of a sparging gas through a spinning nozzle into the melt in a preheat, conditioning and processing step sequence, with a predetermined proportion of hydrogen being employed with the sparging gas during the processing step to assure that the hydrogen content of the melt is such that the density of the solidified product is within a desired range on a repeatable basis. The conditioning step is employed to facilitate the attaining of the desired result on such repeatable basis in an advantageous manner such as to minimize the processing time and the amount of the hydrogen/sparging gas mixture necessary for the desired density control.

19 Claims, No Drawings

METHOD FOR CONTROLLING THE DENSITY OF SOLIDIFIED ALUMINUM

BACKGROUND OF THE INVENTION

1. Field of the Invention

This invention relates to the control of the density of solidified aluminum. More particularly, it relates to an improved method for achieving the desired density control.

2. Description of the Prior Art

When aluminum or aluminum alloys are being refined, it is generally desirable to reduce the dissolved hydrogen content to a low level. When a spinning nozzle is employed in the refining process, gases such as argon or nitrogen are commonly used as a sparging gas dispersed throughout the aluminum melt. Hydrogen is removed from the melt by desorption into bubbles of the sparging gas, while other non metallic impurities in the melt are lifted into a dross layer by flotation. The refining operation is continued until the hydrogen content and the particulate content of the melt are reduced to desirably low levels. In practical commercial operations, the refining operation as carried out in order to reduce the particulate content to a desirable low level may actually serve to also reduce the hydrogen content not only to its desirable low level, but to even lower levels in the absence of precautions to assure against such a result. When aluminum is being refined for direct casting into ingots, such further reduction of the hydrogen content is acceptable and has no adverse consequences. When aluminum or aluminum alloys are being refined for casting into molds for the making of parts, however, the reduction of the hydrogen content to a very low level may result in undesirable part shrinkage.

Such cast part shrinkage can be avoided by the presence of hydrogen in the melt. As the melt solidifies, the evolution of fine hydrogen bubbles tends to offset the normal shrinkage that occurs upon solidification. The hydrogen level in the melt, however, must be maintained within certain limits in order to assure that high quality castings are produced. If the hydrogen level is too low, shrinkage will occur. If, on the other hand, said hydrogen level is too high, excessive porosity will exist in the cast part upon the solidification thereof.

In prior practice, recognition has been given to the need, in instances such as those described above with respect to the casting of aluminum into molds, to control the hydrogen content of the melt to be solidified. One approach that was attempted involved the adding of such hydrocarbons as potatoes to the melt, with the results being very erratic and uncontrolled. Attempts to add hydrogen gas by the bubbling of such gas through a pipe into the melt have proved inefficient and difficult to control because of the large size bubbles formed.

A need thus exists for the development of a method for controlling the hydrogen content of an aluminum melt, and hence the density of the aluminum product solidified therefrom. The ability to obtain such control in a desirably short period of time is an important aspect of this development for effective use in practical commercial operations.

It is an object of the invention, therefore, to provide an improved method for the control of the density of solidified aluminum.

It is another object of the invention to provide an improved method for controlling the density of an aluminum product through the control of the hydrogen content of the melt from which aluminum or aluminum alloys are solidified.

It is a further object of the invention to provide a method for minimizing the time required for achieving a desired hydrogen content level in an aluminum melt on a repeatable basis.

With these and other objects in mind, the subject invention is hereinafter described in detail, the novel features thereof being particularly pointed out in the appended claims.

SUMMARY OF THE INVENTION

A method for rapidly attaining a desired hydrogen content is an aluminum melt has been achieved wherein a hydrogen/inert gas mixture is injected into the melt throuch a spinning nozzle injector, the percentage of hydrogen in said mixture to obtain the desired aluminum product density having been determined at a constant melt temperature for the particular aluminum melt being processed. The melt is conditioned for such determination by initially injecting said inert gas alone therein by means of said spinning nozzle injector, after the preheating thereof, until a relatively constant temperature is achieved, with such conditioning enabling less of the gas mixture to be needed to achieve the desired hydrogen content and consequent density of the solidified aluminum or aluminum alloy product.

DETAILED DESCRIPTION OF THE INVENTION

The objects of the invention have been achieved by the use of a spinning nozzle injector, together with the use of an inert gas for the conditioning of the aluminum melt and of a hydrogen/sparging gas mixture for subsequent hydrogen content control, to achieve the desired density control of the final aluminum or aluminum alloy product. While it had not previously been commercially practical to equilibrate a hydrogen/sparging gas mixture with an aluminum melt because of the slow reaction rates involved, the use of a spinning nozzle injector, or gas dispersion system enables very small bubbles to be generated in the melt, thus serving to accelerate the equilibration of the injected gas with the molten metal. In turn, this enables the overall control method as herein disclosed and claimed to be carried out so as to desirably control the hydrogen content of the aluminum melt, and the density of the solidified melt, in a minimized processing time as desired in the art.

The density control of the invention is an important feature of aluminum processing because it determines the solidification shrinkage of the aluminum, as discussed above. It should be appreciated that different types of casting operations require different amounts of solidification shrinkage. While past efforts have not been successful in accurately controlling such shrinkage, the method of the invention enables the desired density control to be conveniently and accurately achieved for various grades of aluminum and aluminum alloys, said method being readily adaptable to the varying requirements of different applications.

In the practice of the invention, a holding furnace for the molten aluminum is tapped into a ladle on a fork lift truck, or other convenient conveyance, and is transported to a work location at which a spinning nozzle dispersion system is conveniently located at a plant. The spinning nozzle device is lowered into the molten aluminum in the ladle until the cover of the device is seated on the ladle. The spinning nozzle device and system, upon being placed in the molten metal, is preheated, and the bath is conditioned to the presence of the nozzle device until a relatively constant temperature is achieved and can be measured. The proper hydrogen percentage to be employed in the sparging gas injected through the spinning nozzle device into the molten metal is determined, as indicated herein, from said measured, relatively constant temperature for the particular aluminum or alloy being processed. The sparging nozzle device is employed using the proper hydrogen/-sparging gas mixture for a sufficient time to assure that the hydrogen content of the melt reaches the level needed to provide the desired density range in the solidified aluminum produced therefrom. The metal in the ladle can readily be sampled to determine its density.

In the carrying out of such a procedure, the use of a spinning nozzle device, as indicated above, makes it possible to equilibrate a hydrogen/sparging gas mixture with an aluminum melt to obtain any desired density range, a result not obtainable in practical commercial operations using prior art procedures. It will be understood that any suitable spinning nozzle device can be used in the practice of the invention. For example, the spinning nozzle device of the so-called Spinning Nozzle Inert Flotation (SNIF) System for the refining of aluminum, marketed by Union Carbide Corporation, can conveniently be employed for purposes of the invention. Such a device, commonly referred to as a rotating gas distributing means or as a gas injection device, generally comprises a rotor equipped with vertical vanes, said rotor being driven by a motor operated shaft. The driving shaft is commonly shielded from the melt by a sleeve that is fixedly attached at its lower end to a stator. The device is designed so that gas can be introduced into the interior thereof for injection between the stator and the rotor. Simultaneous gas injection and rotor rotation at sufficient pressure and rotation speed cause the desired dispersion pattern of the sparging gas in the melt, thus creating an environment of high turbulence. Such a rotating nozzle device is illustrated in FIG. 1 of the Szekely U.S. Pat. No. 4,040,610. The use of such an efficient agitating device enable the injected gas to be rapidly brought into equilibrium with the molten aluminum such that the desired density control can be achieved by rapidly reaching a hydrogen content at which the ultimate goal of attaining a desired density can be achieved.

The preheat and condition steps of the invention serve to prepare the molten metal, through the evolution of hydrogen that occurs during this time, so that, at the time the sparging gas/hydrogen mixture is employed, the molten metal is closer to the desired hydrogen content. This enables the step in which said sparging gas/hydrogen mixture is injected into the melt to more quickly attain the desired hydrogen content level for the particular aluminum or alloy thereof being processed. This, of course, enables the desired hydrogen content to be achieved with the use of a minimum amount of said mixed gas.

It should be noted that the sparging gas is injected into the melt through the spinning nozzle device during the initial preheat and condition steps. Sparging gas is also passed under the cover of the spinning nozzle distribution means to assure that a desired atmosphere exists in the space within the ladle above the level of melt therein. Such a flow of sparging gas to the cover portion of the device is continued during the processing step in which the mixed gas is injected into the melt for desired hydrogen control.

The invention is further described herein with respect to an illustrative example of the invention. It will be understood that such example is provided to further describe and illustrate the manner in which the invention is carried out with respect to a particular alloy desired to be processed, said example not to be construed as limiting the scope of the invention as more generally described herein and recited in the appended claims.

In the example, it is desired to attain a density within the range of from about 2.4 to 2.5 g/cc for a 380 aluminum alloy. Because the density of an aluminum metal does not have a known, defined relationship to the hydrogen content thereof, it is necessary to use empirical data to determine the proportion of hydrogen to be included in the hydrogen/sparging gas mixture used in the practice of the invention. Upon transport of a melt of said 380 alloy in a ladle to a SNIF processing location, the SNIF spinning nozzle is lowered into the ladle, and the cover of the SNIF system is seated onto the ladle. During this time, 0.2 cubic feet per minute (CFM) of argon is passed, as an inert sparging gas, into the melt through said nozzle, which is not being rotated during this time. With the unit in place, the nozzle is rotated at 400 RPM for 1.5 minutes at the same argon flow rate to preheat the SNIF system. During this time and during the following step of conditioning the molten bath until a constant temperature is reached, 1.0 CFM of argon is passed under the cover to maintain an inert atmosphere above the surface of said molten bath. During the condition step lasting 1.12 minutes with said nozzle being rotated at said 400 RPM, 0.5 CFM of argon is injected through the spinning nozzle into the melt. Upon reaching a relatively constant temperature of about 1400° F. in this time, the amount of hydrogen to be included in an argon/hydrogen mixture to be employed as a sparging gas for said 380 alloy in a further process step to obtain a 2.4–2.5 g/cc density range is determined using the following equation:

$$\% H_2 = (-0.0667)\ T°F. + 103.2 \quad (1)$$

The equation is empirically derived for this particular alloy and desired density range. In this example, the percentage of hydrogen should be zero at temperatures of 1547° F. or above. At temperatures of 1322° or below, on the other hand, a 15% or higher proportion of hydrogen should be employed in the hydrogen/sparging gas mixture. At the 1400° F. temperature level referred to above, it is desirable to employ an argon/hydrogen gas mixture containing about 9.82% hydrogen. In the practice of the invention, it has been found convenient to employ the gas mixture by the supply of two gas streams to the nozzle, one comprising essentially pure argon and the other comprising a premixed 15% hydrogen in argon supply as the source of hydrogen. Each gas is supplied in proper amount to achieve the hydrogen percentage of the overall hydrogen/sparging gas mixture. In the illustrative example, a total of 3 CFM of the hydrogen/argon mixture is employed, with 1.96 CFM of said premixed 15% hydrogen and 1.04 CFM of argon being supplied to the spinning SNIF for this purpose.

In the empirical development of equation (1) for said 380 alloy and said desired density range, samples of the melt were analyzed to determine the density thereof by the following method. An approximately 150 g sample of the molten metal was carefully scooped out of the melt with a preheated iron crucible, which was placed under a bell jar that was then evacuated to exactly 28 inches of mercury. These conditions were maintained while the molten sample solidified. The density of the solidified metal was determined by weighing it in or out of water and using the following formula:

$$\text{Density (g/cc)} = \frac{\text{Dry Weight (g)}}{\text{Dry Weight (g)} - \text{Wet Weight (g)}} \quad (2)$$

Those skilled in the art will appreciate that any other suitable density measuring procedure can be employed for purposes of the invention. With such convenient density measurements, the amount of argon and hydrogen can be related to obtain an applicable equation enabling the percentage of hydrogen to be employed in the hydrogen/sparging gas mixture to be determined, e.g. said equation (1) above relating particularly to said 380 alloy and desired density range of solidified product. Similarly, the time period required for the process step in which the hydrogen/sparging gas mixture is injected into the melt following the conditioning thereof can be routinely determined. Samples of the metal are taken, and the densities thereof are determined as indicated above to conveniently establish the required time for said process step.

In the illustrative example, the process step is carried out for five minutes, with the SNIF spinning nozzle being rotated at said 400 RPM with 0.5 CFM of argon being passed under the cover of the SNIF system. Those skilled in the art will appreciate that the flow rate of sparging gas under the cover of the SNIF system and the manner in which the proper percentage of hydrogen is obtained, as by any convenient premix composition, is subject to change and modification within the scope of the invention.

Those skilled in the art will appreciate that, upon determining the percentage of hydrogen to be employed in the gas mixture, and the length of time required for the process step, in order to reach the desired hydrogen content of the melt corresponding to the desired density of the solidified part, subsequent ladles can be rapidly and conveniently processed using the preheat, condition and process step sequence of the invention to achieve the desired density control. Thus, the empirical relationships determined with the first ladle batch as indicated above pertain and can be used with respect to subsequent batches tapped from the same holding furnace supply.

It is within the scope of the invention to make various changes or modifications in the details of the invention as herein described without departing from the scope of the appended claims. For example, the sparging gas employed in the practice of the invention may be either argon, as in the illustration, or nitrogen or some other sparging gas, as in prior art refining practice. Also indicated above, any convenient spinning nozzle device capable of rapidly dispersing small bubbles of gas in the melt may be utilized to desirably accelerate the equilibration of the injected gas with the molten metal. As the invention can be used for the desired density control over any particular aluminum or aluminum alloy, it enables high quality castings to be produced in a wide variety of applications in which density control is essential for necessary quality control of the cast aluminum product.

It should be understood that equation (1) above requires adjustment from case-to-case depending upon the aluminum or aluminum alloy being processed, the desired density range of the solidified cast product or other product the density of which is desired to be controlled, the particular apparatus or system being used for the density control purposes and the like. Such adjustment can be readily made based on empirical data, e.g., the density measurements of samples as referred to herein. It is necessary to employ such empirical data since, as indicated above, the ultimate goal of the processing operation is not to achieve a certain hydrogen content, but to attain a desired density range for the solidified metal. When the appropriate empirical relationship has been established using density data for the particular melt being processed at the temperature measured in said condition step, said temperature can be used to predetermine the percentage of hydrogen to be employed with the sparging gas to achieve the desired results and benefits of the invention in continuing commercial aluminum casting or other aluminum solidification operations. Using the appropriate hydrogen/sparging gas mixture, the melt process is carried out for a predetermined period of time sufficient to enable the hydrogen content of the melt to reach the appropriate level so that the solidified product will have a density falling within a desired density range for the particular aluminum or aluminum alloy being processed for a given application. The density of the final products can, of course, be checked by further sampling of the melt and the making of density measurements as commercial operations are continued for a particular melt and application.

In carrying out the preheat and bath conditioning steps of the invention, the molten bath, as indicated above, is brought to a point closer to the desired hydrogen content thereof so that less mixed gas is needed in the subsequent process step. To facilitate this aspect of the invention, it is generally preferred, as in the example above, to increase the flow of sparging gas, e.g., argon, during said conditioning step. The amount of such increase in flow rate will be determined on the basis of the overall conditions applicable to any given application, and may commonly range from about doubling the flow rate, to the use of the 2½ time increase of the example, to even greater increases in order to facilitate the obtaining of the desired density control in as minimum a period of time as practical for the application. It is also desirable in the practice of various Practical embodiments of the invention to lower the spinning nozzle gas injector to just above the level of melt in the ladle and to hold the injector in this position or to very slowly lower it therefrom into the melt, as opposed to more rapidly lowering the injector into the melt. The reason for this slight holding period above the level of the melt is to assure that any moisture present in the spinning nozzle system is drivencff by the heat of the melt, prior to the lowering of the injector into said melt. Those skilled in the art will appreciate that the cover portion of the spinning nozzle gas injector means generally has temperature measuring means, e.g., a thermocouple, attached thereto. The preheat step thus involves preheating said spinning nozzle injector and said temperature measuring means upon the lowering of said injector into the molten bath and while causing said spinning nozzle injector to rotate and passing sparging gas through said injector into the molten bath.

With respect to the desired results and benefits of the invention, it should be noted again that hydrogen/-sparging gas mixtures have heretofore been employed in an attempt to achieve the desired density control of the solidified metal. In addition, the use of a spinning nozzle injector has been investigated as a means for improving such gas mixture addition. As indicated above, some early efforts provided very erratic, uncontrolled results. If, for one sample, the desired density control was properly achieved, subsequent samples might be outside the required density range on either the high or the low side. There is a genuine desire in the art that a density control method be developed in which the desired density range can be attained repeatedly for practical commerical application. The mere use of hydrogen/sparging gas mixture in some manner improving upon the earlier random and erratic performance is not sufficient for practical operating success, and does not constitute the subject invention where repeatable successful performance is not achieved. Likewise, the use of spinning nozzle injector means for the injecting of such a gas mixture, or of the sparging gas alone, into the molten bath is not sufficient of itself, to achieve successful performance, and does not constitute the invention, where such injector means and said gas mixture are not employed in a manner such as to repeatedly enable the desired density to be achieved. In addition, the development desired in the art, and achieved in the practice of the invention, must be one that not only significantly increases the ability to repeatedly deliver metal densities within the desired range, but is able to achieve this desired result in a practical period of time for commercial metal processing and solidification operations. The method of the invention achieves these results in that it can be carried out expeditiously, with the spinning nozzle injector making it possible to rapidly equilibrate an injected gas or gas mixture with the aluminum or other metal melt for rapid control of the hydrogen content thereof and of the density of the final product on a repeatable basis. Such repeatable basis, it will be understood, denotes that the final product can be produced at a desired density range predictably and reliably on a repeative basis. In the absence of such repeatability, an undesirable proportion of final products will be found to have densities outside the desired range, requiring either that they be discarded or returned to the refining operation for further processing. In the practice of the invention, however, a significant improvement over the prior art operations can be achieved. Thus, the invention enable acceptable products to be achieved on a significantly more repeatable basis, with the invention providing the flexibility, reliability and predictability necessary for practical commercial success in the timely processing of a variety of metal solidification operations.

The invention will thus be seen to fulfill a significant need in the art. As the benefits of the invention become fully appreciated, it is anitcipated that a wide variety of operations in which aluminum is cast into molds will be seen to be enhanced by the practice of the invention, with a resultant increase in the quality of valuable cast aluminum products for a wide variety of industrial and other significant applications.

I claim:

1. An improved method for controlling the density of solidified aluminum comprising:

(a) introducing molten aluminum or aluminum alloy containing dissolve hydrogen into a ladle as a bath of molten aluminum metal;

(b) lowering spinining nozzle gas injector means into the bath of molten aluminum metal in said ladle, said spinning nozzle gas injector means having a ladle cover portion and temperature measuring means, said ladle cover being seated on the ladle upon completion of said lowering of the spinning nozzle gas injector means into the both of molten aluminum metal in said ladle;

(c) preheating said spinning nozzle gas injector means, including said temperature measuring means, in the both of molten aluminum metal, while causing said spinning nozzle gas injector means to rotate and while passing sparging gas through said spinning nozzle gas injector means into the bath of molten aluminum metal;

(d) conditioning said bath of molten aluminum metal unitl a relatively constant temperature is achieved, and measured by said temperature measuring means, by continuing to rotate said spinning nozzle gas injector means and continuing to pass sparging gas through the spinning nozzle gas injector means into the bath of molten aluminum metal, this conitioning step causing the evolution of hydrogen from the both of molten aluminum metal;

(e) processing the bath of molten aluminum metal by the continued rotation of said spinning nozzle gas injector means and the passing of said sparging gas through the spinning nozzle gas injector means into the bath of molten aluminum metal for a time sufficient to enable the hydrogen content of the bath of molten aluminum metal to reach a level such that the molten aluminum metal therein, upon solidification, will have a density within a desired range, said sparging gas being injected into the bath of molten aluminum metal alone or as a gas mixture compromising said sparging gas and hydrogen in a predetermined proportion based on said constant temperature achieved and measured in the conditioning step (d) such as to facilitate the attaining of said desired hydrogen content of the bath of molten aluminum metal; and (f) causing said bath of molten aluminum metal having a controlled hydrogen content to solidify to form the product metal part having a density within the desired range for said part, whereby the preconditioning and conditioning steps facilitate the preparation of the bath of molten aluminum metal so that the processing step using said sparging gas or hydrogen/sparging gas mixture can be carried out rapidly ad with minimized use of said gas mixture to attain the desired density control for any desired aluminum or other product on a repeatable, relaiable and predictable basis.

2. The method of claim 1 which the metal employed is an alloy of aluminum.

3. The method of claim 2 in which said aluminum alloy comprises aluminum alloy 380.

4. The method of claim 1 in which the flow rate of the sparging gas injected into the bath of molten aluminum metal in conditioning step (d) is greater than that employed in preheating step (c).

5. The method of claim 4 in which the flow rate of said sparging gas during said conditioning step (d) is at least twice that employed during preheating step (c).

6. The method of claim 1 in which said spinning nozzle gas injector means is held in a position above the level of the bath of molten aluminum metal in said ladle for a period of time sufficient to drive off any moisture present on said injector means before said injector means is lowered into said molten bath in the ladle.

7. The method of claim 1 in which the sparging gas comprises argon.

8. The method of claim 1 in which the sparging gas comprises nitrogen.

9. The method of claim 3 in which the sparging gas comprises argon.

10. The method of claim 1 in which the predetermined proportion of hydrogen used in the hydrogen/argon mixture exployed in processing step (e) is determined from the temperature achieved in conditioning step (d) and the desired density range of the solidified product.

11. The method of claim 10 in which the metal employed is an alloy of aluminum.

12. The method of claim 10 in which said metal employed comprises aluminum.

13. The method of claim 11 in which said aluminum alloy comprises aluminum alloy 380.

14. The method of claim 13 in which said predetermined proportion of hydrogen is determined in accordance with the following equation:

$$\% H_2 = (-0.0667)\ T°F. + 103.2.$$

15. The method of claim 14 in which said temperature achieved in conditioning step (d) is about 1400° F., the gas mixture injected into the bath of molten aluminum metal in processing step (e) containing about 9.82% hydrogen.

16. The method of claim 15 in which the flow rate of the sparging gas during said conditioning step (d) is at least twice that employed during preheating step (c).

17. The method of claim 16 in which said flow-rate in step (d) is about 2½ times that employed in step (c).

18. The method of claim 15 in which the desired product density is about 2.4–2.5 g/cc.

19. The method of claim 1 in which solidified metal part comprises a part cast in a mold.

* * * * *